US007434289B2

(12) United States Patent
Sumiyoshi et al.

(10) Patent No.: US 7,434,289 B2
(45) Date of Patent: Oct. 14, 2008

(54) POLISHER BRUSH HAVING WIRE-SHAPED GRINDING ELEMENTS

(75) Inventors: Takehiko Sumiyoshi, deceased, late of Shinjuku-ku (JP); by Sachiko Sumiyoshi, legal representative, Shinjuku-ku (JP); by Norihiko Sumiyoshi, legal representative, Shinjuku-ku (JP); by Yoshihiko Sumiyoshi, legal representative, Shinjuku-ku (JP); Suguru Matsushita, Kamiina-gun (JP); Atsushi Odaka, Kamiina-gun (JP)

(73) Assignees: XEBEC Technology Co. Ltd., Tokyo (JP); Taimei Chemicals Co., Ltd., Nagano (JP)

( * ) Notice: Subject to any disclaimer, the term of this patent is extended or adjusted under 35 U.S.C. 154(b) by 860 days.

(21) Appl. No.: 10/502,012

(22) PCT Filed: Jul. 11, 2003

(86) PCT No.: PCT/JP03/08866

§ 371 (c)(1),
(2), (4) Date: Jul. 21, 2004

(87) PCT Pub. No.: WO2004/009293

PCT Pub. Date: Jan. 29, 2004

(65) Prior Publication Data

US 2005/0153642 A1 Jul. 14, 2005

(30) Foreign Application Priority Data

Jul. 22, 2002 (JP) ..... 2002-212249

(51) Int. Cl.
*A46B 13/02* (2006.01)
*B24D 13/00* (2006.01)

(52) U.S. Cl. ..... 15/179; 451/490

(58) Field of Classification Search ..... 15/179, 15/184; 451/490, 526
See application file for complete search history.

(56) References Cited

U.S. PATENT DOCUMENTS 1,510,157 A * 9/1924 Pembert ..... 15/104.011

(Continued)

FOREIGN PATENT DOCUMENTS

| | | |
|---|---|---|
| EP | 1 116 553 A2 | 7/2001 |
| EP | 1 217 105 A1 | 6/2002 |
| JP | 63-53666 | 4/1988 |

(Continued)

OTHER PUBLICATIONS

A Supplementary European Search Report issued in a corresponding European application.

*Primary Examiner*—David B Thomas
(74) *Attorney, Agent, or Firm*—Buchanan Ingersoll & Rooney PC

(57) ABSTRACT

In the manufacture of a brush-shaped grindstone (3), embedding holes (310) are formed in a grinding element holding surface (311) of a holder (31) in mutually separated positions. A base end side of a plurality of wire-shaped grinding elements (32), formed such that a composite yarn composed of inorganic filaments is impregnated and hardened with a resin, is aligned, and rod assemblies (320) are thereafter formed by fixing the base end side of the plurality of wire-shaped grinding elements (32) with adhesive (71) in holes (60) of a die material (6), which is formed to have substantially the same size as the embedding holes (310) of the holder (31). The rod assemblies (320) are thereafter embedded in the embedding holes (310) of the holder (32), and fixed with adhesive (72). Whereby, removing burrs from a precision work component, performing polishing, and the like can be carried out with good efficiency and high precision.

3 Claims, 12 Drawing Sheets

U.S. PATENT DOCUMENTS

| | | | | | |
|---|---|---|---|---|---|
| 2,608,034 | A | * | 8/1952 | Fromson | 451/468 |
| 3,312,993 | A | * | 4/1967 | Nelson | 15/180 |
| 3,343,195 | A | * | 9/1967 | Menges | 15/179 |
| 3,383,727 | A | * | 5/1968 | Hanson | 15/104.04 |
| 3,696,563 | A | * | 10/1972 | Rands | 451/466 |
| 4,367,389 | A | * | 1/1983 | Inoue | 219/69.17 |
| 4,561,214 | A | * | 12/1985 | Inoue | 451/1 |
| 5,233,719 | A | * | 8/1993 | Young et al. | 15/179 |
| 5,406,669 | A | * | 4/1995 | Lesiw | 15/179 |
| 5,518,794 | A | * | 5/1996 | Barber et al. | 428/95 |
| 5,575,704 | A | * | 11/1996 | Hotani | 451/36 |
| 6,309,291 | B1 | * | 10/2001 | Cox | 451/464 |
| 6,352,471 | B1 | * | 3/2002 | Bange et al. | 451/527 |
| 6,413,287 | B1 | * | 7/2002 | Barber, Jr. | 51/298 |
| 6,422,932 | B1 | * | 7/2002 | Lageson et al. | 451/466 |
| 2002/0189043 | A1 | * | 12/2002 | Dondi et al. | 15/181 |

FOREIGN PATENT DOCUMENTS

| | | | | |
|---|---|---|---|---|
| JP | 02-107462 | | | 8/1990 |
| JP | 2000094344 | A | * | 4/2000 |
| JP | 2001-138251 | | | 5/2001 |
| JP | 2002210661 | A | * | 7/2002 |
| JP | 2002210662 | A | * | 7/2002 |
| JP | 2002254277 | A | * | 9/2002 |
| JP | 2003-62761 | | | 3/2003 |
| JP | 2003-136413 | | | 5/2003 |

* cited by examiner

POLISHER BRUSH HAVING WIRE-SHAPED GRINDING ELEMENTS

TECHNICAL FIELD

The present invention relates to a manufacturing method for a brush-shaped grindstone for deburring and polishing, to a brush-shaped grindstone manufactured with this method, and to a polisher brush that uses this brush-shaped grindstone.

BACKGROUND ART

Precision components primarily used in automobile parts, aircraft parts, and the like are worked with precision and high accuracy primarily by means of numerically controlled lathes, numerically controlled milling machines, machining centers, robots, special purpose machines, and other automatic machines, using end mills, drills, dies, taps, grindstones, and other tools. However, after these precision machines have worked, burrs, work marks, tool marks, or the like are always present, so post-working is required to remove these. Such post-working tools conventionally involve the use of nylon brushes with abrasive grain, brass brushes, wire brushes, shot blasts, barrels, paper, and the like. Much of the final finishing process further involves manual work.

However, nylon brushes with abrasive grains, brass brushes, wire brushes, shot blasts, barrels, paper, or the like, used in conventional working have drawbacks in that removal efficiency of these burrs, work marks, and the like, and the polishing efficiency is poor. Conventional post-working tools have poor working accuracy, and have drawbacks in that burrs, work marks, and the like are left, and there is great variation in the manufacturing quality after working.

In the particular case of deburring that involves precision components, it is possible that defective operation of sliding portions, blockage of hydraulic pathways, shorting of electrical circuits, oil leaks, and other critical flaws will result if parts that have burrs left behind or that have variation in manufacturing quality after burr removal are assembled into an apparatus.

In conventional practice, therefore, burrs are primarily removed from precision components by hand in a separate step away from the automated line, total inspection is performed thereafter, and it is therefore difficult to automate burr removal.

DISCLOSURE OF INVENTION

An object of the present invention is to provide a brush-shaped grindstone and a manufacturing method thereof whereby burrs, work marks, and the like can be removed from precision work components, polishing can be performed, and other processes can be conducted with good efficiency and high accuracy.

Another object of the present invention is to provide a brush for polishers that are suitable for automating the removal of burrs, work marks, and the like, and for automating polishing operations in which a brush-shaped grindstone is used.

To solve the drawbacks described above, according to the present invention, there is provided a manufacturing method for a brush-shaped grindstone having wire-shaped grinding elements formed such that a composite yarn composed of inorganic filaments is impregnated and hardened with a resin, and also having a holder for holding base end sides of a plurality of wire-shaped grinding elements on a grindstone holding surface, comprising steps of forming a plurality of embedding holes that open on the grindstone holding surface in isolated positions; forming rod assemblies by bringing a plurality of wire-shaped grinding elements together; and embedding base end sides of the rod assemblies in the embedding holes and fixing with adhesive.

In the manufacturing method for the brush-shaped grindstone of the present invention, the rod assemblies are separated from each other because the plurality of embedding holes are formed in isolated positions on the grindstone holding surface of the holder. The grindability is therefore excellent because the shavings are efficiently expelled during grinding work and the heat dissipating effect is high. Removal of burrs and work marks from the precision work component, polishing, and other processes can further be performed with good efficiency and high accuracy. The cost can also be reduced because high grinding performance can be obtained with a small number of rods.

Furthermore, in the case of nylon filaments containing abrasive grain, the nylon filaments can be prevented from unraveling by folding base end sides to provide thickness and then embedding the filaments in holes in the holder, but when wire-shaped grinding elements composed of inorganic filaments are used, the base end sides cannot be folded as can nylon filaments containing abrasive grain because wire-shaped grinding elements composed of inorganic filaments break when folded. According to the present invention, however, the wire-shaped grinding elements do not unravel, because the base end sides of the rod assemblies are fixed inside the embedding holes of the holder with adhesive. The brush-shaped grindstone can be efficiently manufactured because a plurality of rod assemblies are batch manufactured, and these are inserted in succession in the embedding holes of the holder and fixed with adhesive. The configuration is one in which large numbers of wire-shaped grinding elements are subdivided as rod assemblies and fixed, so the safety is high because the wire-shaped grinding elements remain mostly in place. Even when the grinding performance is increased with the cross-sections of the wire-shaped grinding elements in an elliptical shape, the orientation of the cross-sectional shapes thereof are random, so the grinding performance can be further improved and the roughness of finished surface can be improved.

In the present invention, for example, round holes are formed as the embedding holes in the holder, and when the rod assemblies are formed, the plurality of wire-shaped grinding elements are roundly bundled.

In the present invention, grooves are formed as the embedding holes in the holder, and when the rod assemblies are formed, the plurality of wire-shaped grinding elements may be flatly aligned.

In the present invention, the wire-shaped grinding elements can take a configuration in which the inorganic filaments form a composite yarn without being twisted, or a configuration in which the inorganic filaments form a composite yarn having been twisted. Of these configurations, when inorganic filaments form a composite yarn having been twisted, an advantage is obtained whereby leading ends of the wire-shaped grinding elements are resistant to splitting.

In the present invention, the cross-sections of the wire-shaped grinding elements can take a configuration in which the shape is substantially circular, or a configuration in which the shape is flat. When the cross-sections of the wire-shaped grinding elements are flat, plugging is less likely to occur during burr removal and polishing work than with the configuration in which the shape of the cross-section is substantially circular. An advantage is obtained whereby flexibility is exhibited in the wire-shaped grinding elements, and breaking is minimized. When the cross-sections of the wire-shaped grinding elements are flat, the ratio of flatness represented by L/T is preferably 1.6 to 15, but is more preferably in a range of 1.6 to 10, where L is the major diameter of the cross-section, and T is the minor diameter of the cross-section.

The brush-shaped grindstone in which the present invention is applied may, for example, be used as a polisher brush in which the holder is fixed with screws on an interior side of a brush case so that free ends of the wire-shaped grinding elements protrude from a lower end portion of the brush case.

In this case, a spindle extended inside of the brush case in an axial direction thereof, and guide holes extended in the form of grooves in a peripheral wall of the brush case in the axial direction of the brush case; an axle hole in which the spindle is fitted, and screw holes that extend from an external peripheral surface of the holder to the axle hole are formed in the holder; and the screws are secured in the screw holes so as to be attached to the external peripheral side of the brush case and to pass completely through the guide holes in a state in which leading end portions of screw shafts make contact with an external peripheral surface of the spindle.

In a polisher brush thus configured, when the brush-shaped grindstone is inserted from a holder side into an interior side of the brush case, the spindle is inserted through the axle hole of the holder. In this state, the screws are inserted into guide holes from an external peripheral side of the brush case until the leading end portions of the screw shafts come in contact with the external peripheral surface of the spindle, and axle portions of the screws tighten in the screw holes of the holder. As a result, the holder is fixed onto the spindle inside the brush case. If the screw is loosened, the protruding length of the wire-shaped grinding elements at the lower end portion of the brush case can be adjusted by moving the holder along the spindle. The axle portion of the screw is guided at this time in the guide holes, and the brush-shaped grindstone moves along the guide holes. The protruding length of the wire-shaped grinding elements at the lower end portion of the brush case can therefore be easily adjusted.

The holder is fitted within the brush case, and because the spindle is fitted into the axle hole of the holder, the holder does not tilt inside the case even in the cased of considerable dimensional tolerance between an outer diameter of the holder and an inner diameter of the brush case. There is therefore no variation in the protruding length of the wire-shaped grinding elements. Because the spindle is fitted into the axle hole of the holder, the holder can remain fixed at a center position of the brush case even with considerable dimensional tolerance between the outside diameter of the holder and the inside diameter of the brush case. Thus, because the dimensional tolerance between the outside diameter of the holder and the inside diameter of the brush case need not be strict, even when shavings enter the space between these, the protruding length of the wire-shaped grinding elements at the lower end portion of the brush case can be easily adjusted because the holder can be smoothly moved inside the brush case by loosening the screw.

Even when the wire-shaped grinding elements attempt to escape to the external peripheral side as the polisher brush is rotated to perform polishing or the like, they bump against the interior surface of the peripheral wall of the brush case and are held back, and when the elements attempt to escape to the interior peripheral side, they bump against the external peripheral surface of the spindle and are held back. As a result, there is no difference in the extent of escape between the wire-shaped grinding elements positioned on an external peripheral side and the wire-shaped grinding elements positioned on an interior peripheral side. The situation in which the wire-shaped grinding elements positioned on the interior peripheral side become less abrasive can therefore be avoided because no difference in rigidity is exhibited between the wire-shaped grinding elements positioned on the external peripheral side and the wire-shaped grinding elements positioned on the interior peripheral side. The working precision can also be improved because the wire-shaped grinding elements are uniformly abraded. Since no variation occurs in the length (strand length) of the wire-shaped grinding elements from the holder, the change in conformability and grindability due to this effect is reduced, so the working precision is stable.

In the present invention, the surrounding area where the leading ends of screw shafts contact on the external peripheral surface of the spindle is preferably a flat surface.

The spindle is normally formed from a round rod or circular pipe, and the leading end portions of the screw shafts are brought into contact with the external peripheral surface thereof. Fashioning the surrounding area in contact with the leading end portions of the screw shafts in a flat surface prevents the leading end portions of the screw shafts from shifting on the external peripheral surface of the spindle even when the polisher brush rotates at high speed, because the leading ends of the screw shaft make stable contact with the external peripheral surface of the spindle. A space is further formed between the external peripheral surface of the spindle and the internal peripheral surface of the axle hole of the holder in the portion in which this flat surface is formed because the surrounding area where the leading end portions of the screw shafts make contact is flat. Therefore, even when the dimensional tolerance between the outside diameter of the spindle and the inside diameter of the axle hole is strict, and the tilt and eccentricity of the holder are more strictly prevented, problems do not arise whereby the holder inside the brush case ceases moving due to the shavings that enter between the external peripheral surface of the spindle and the internal peripheral surface of the axle hole. Even if the spindle is damaged by contact with the leading end portion of the screw, the holder can be smoothly moved inside the brush case because the holder is not prevented from moving inside the brush case if the damage is to the flat surface.

In the present invention, the guide holes preferably extend parallel in the axial direction on the peripheral wall of the brush case. Such a configuration allows guide holes to easily be formed even if the peripheral wall of the brush case is cylindrical.

The guide holes may also be configured so as to extend in a direction diagonal to the axial direction on the peripheral wall of the brush case. When the guide holes that guide the brush-shaped grindstone extend on the peripheral wall of the brush case in a direction diagonal to the axial direction thereof, the position in the axial direction of the brush-shaped grindstone within the brush case can be easily adjusted in small increments. The stiffness of the wire-shaped grinding elements, in other words, the grindability and conformability can easily and quickly be adjusted to an optimal state because the protruding length of the free ends of the wire-shaped grinding elements can easily and quickly be adjusted to an optimal length. This provides an advantage in that the movement of the brush-shaped grindstone is smooth even when the brush-shaped grindstone does not easily move inside the brush case, because force is applied to the brush-shaped grindstone in the direction in which the brush-shaped grindstone rotates about the axis line.

In the present invention, when the guide holes extend parallel in the axial direction on the peripheral wall of the brush case, or when the guide holes are configured so as to extend in a direction diagonal to the axial direction on the peripheral wall of the brush case, a projecting portion that projects to the external peripheral side is preferably attached to the lower end side of the spindle.

With this configuration, even when the wire-shaped grinding elements attempt to escape to the external peripheral side when the polisher brush is rotated to perform polishing or the like, they bump against the interior surface of the peripheral wall of the brush case and are held back, and if the elements attempt to escape to the interior peripheral side, they bump against the external peripheral side of the projecting portion disposed on the spindle and are held back. As a result, there is no difference in the extent of escape between the wire-shaped grinding elements positioned on the external peripheral side and the wire-shaped grinding elements positioned on the interior peripheral side. The situation in which the wire-shaped grinding elements positioned on the interior peripheral side become less abrasive can therefore be avoided because no difference in rigidity is exhibited between the wire-shaped grinding elements positioned on the external peripheral side and the wire-shaped grinding elements positioned on the interior peripheral side. The working precision can also be improved because the wire-shaped grinding elements are uniformly abraded. Since no variation occurs in the length (strand length) of the wire-shaped grinding elements from the holder, the change in conformability and grindability due to this effect is reduced, so the working precision is stable. At this point, if the projecting portion is attached with screws and screw stops so as to allow easy removal, the work of replacing worn wire-shaped grinding elements can easily be performed.

In the present invention, when the guide holes extend parallel in the axial direction on the peripheral wall of the brush case, a projecting portion that projects to the external peripheral side is preferably attached to the lower end side of the spindle, a plurality of protrusions extended in a radial manner toward the external peripheral side are formed on an external peripheral side of the projecting portion, and the wire-shaped grinding elements are evenly positioned between the protrusions.

With this configuration, even when the wire-shaped grinding elements attempt to escape to the external peripheral side, they bump against the interior surface of the peripheral wall of the brush case and are held back. When the wire-shaped grinding elements attempt to escape to the interior peripheral side, they bump against the external peripheral side of the projecting portion disposed on the spindle and are held back, and the range of escape is narrowed by the protrusions. As a result, there is no difference in the extend of escape between the wire-shaped grinding elements positioned on the external peripheral side and the wire-shaped grinding elements positioned on the interior peripheral side. The situation in which the wire-shaped grinding elements positioned on the interior peripheral side become less abrasive can therefore be avoided because no difference in rigidity is exhibited between the wire-shaped grinding elements positioned on the external peripheral side and the wire-shaped grinding elements positioned on the interior peripheral side. The working precision can also be improved because the wire-shaped grinding elements are uniformly abraded. Since no variation occurs in the length (strand length) of the wire-shaped grinding elements from the holder, the change in conformability and grindability due to this effect is reduced, so the working precision is stable. Variation in the rigidity of the wire-shaped grinding elements can be reduced in the peripheral direction as well because the protrusions prevent the wire-shaped grinding elements from escaping in the peripheral direction. At this point, if the projecting portion is attached with screws and screw stops so as to allow easy removal, the work of replacing worn wire-shaped grinding elements can easily be performed.

In the present invention, when the guide holes extend parallel in the axial direction on the peripheral wall of the brush case, a plurality of protrusions extended in a radial manner toward the external peripheral side are preferably attached to the spindle, and the wire-shaped grinding elements are evenly positioned between the protrusions.

With this configuration, even when the wire-shaped grinding elements attempt to escape to the external peripheral side, they bump against the interior surface of the peripheral wall of the brush case and are held back. When the wire-shaped grinding elements attempt to escape to the interior peripheral side, they bump against the external peripheral side of the spindle and are held back, and the range of escape is narrowed by the protrusions. As a result, there is no difference in the extend of escape between the wire-shaped grinding elements positioned on the external peripheral side and the wire-shaped grinding elements positioned on the interior peripheral side. The situation in which the wire-shaped grinding elements positioned on the interior peripheral side become less abrasive can therefore be avoided because no difference in rigidity is exhibited between the wire-shaped grinding elements positioned on the external peripheral side and the wire-shaped grinding elements positioned on the interior peripheral side. The working precision can also be improved because the wire-shaped grinding elements are uniformly abraded. Since no variation occurs in the length (strand length) of the wire-shaped grinding elements from the holder, the change in conformability and grindability due to this effect is reduced, so the working precision is stable. Variation in the rigidity of the wire-shaped grinding elements can be reduced in the peripheral direction as well because the protrusions prevent the wire-shaped grinding elements from escaping. At this point, if the projecting portion is attached with screws and screw stops so as to allow easy removal, the work of replacing worn wire-shaped grinding elements can easily be performed.

SYMBOLS

Figure 1:
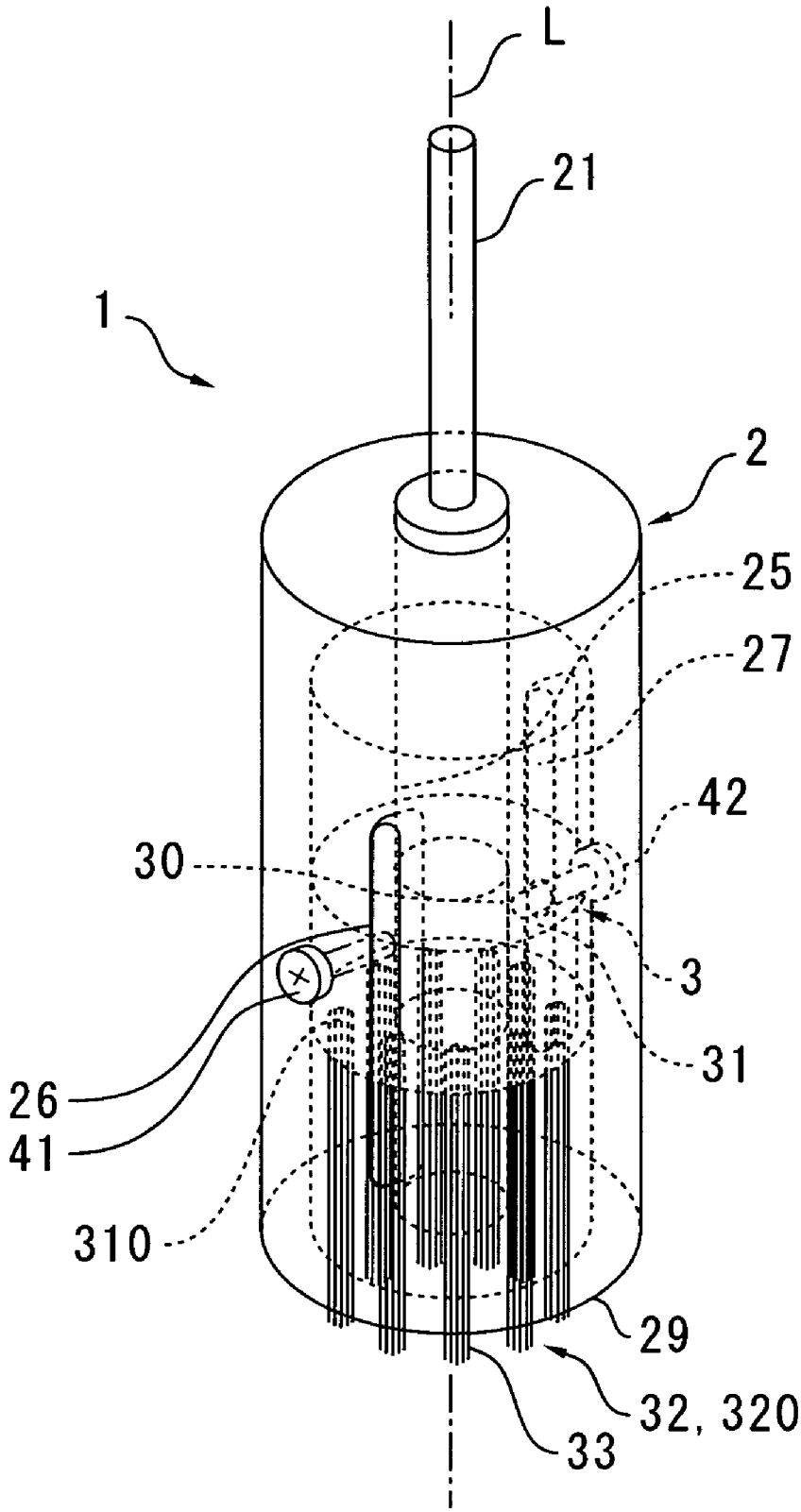
FIG. 1 is a diagram depicting the state in which the upper portion of the brush-shaped grindstone is inserted and fixed in the interior of the brush case in a polisher brush wherein the present invention has been applied.

1 polisher brush
2 cylindrical brush case
3, 3A, 3B, 3C, 3E, 3F brush-shaped grindstones
6 die material
20 peripheral wall
21 connecting shaft for driving
25 spindle
26, 27 guide holes
30 axle hole
31 holder
32 wire-shaped grinding element
33 free end of the wire-shaped grinding element
36, 37 screw holes
41,42 screw
60 hole of the die material
71,72 adhesive
310 embedding hole
311 grindstone holding surface
320 rod assembly
L axis line

BEST MODE FOR CARRYING OUT THE INVENTION

Embodiments of the present invention will now be described with reference to the drawings.

Embodiment 1

Figure 2:
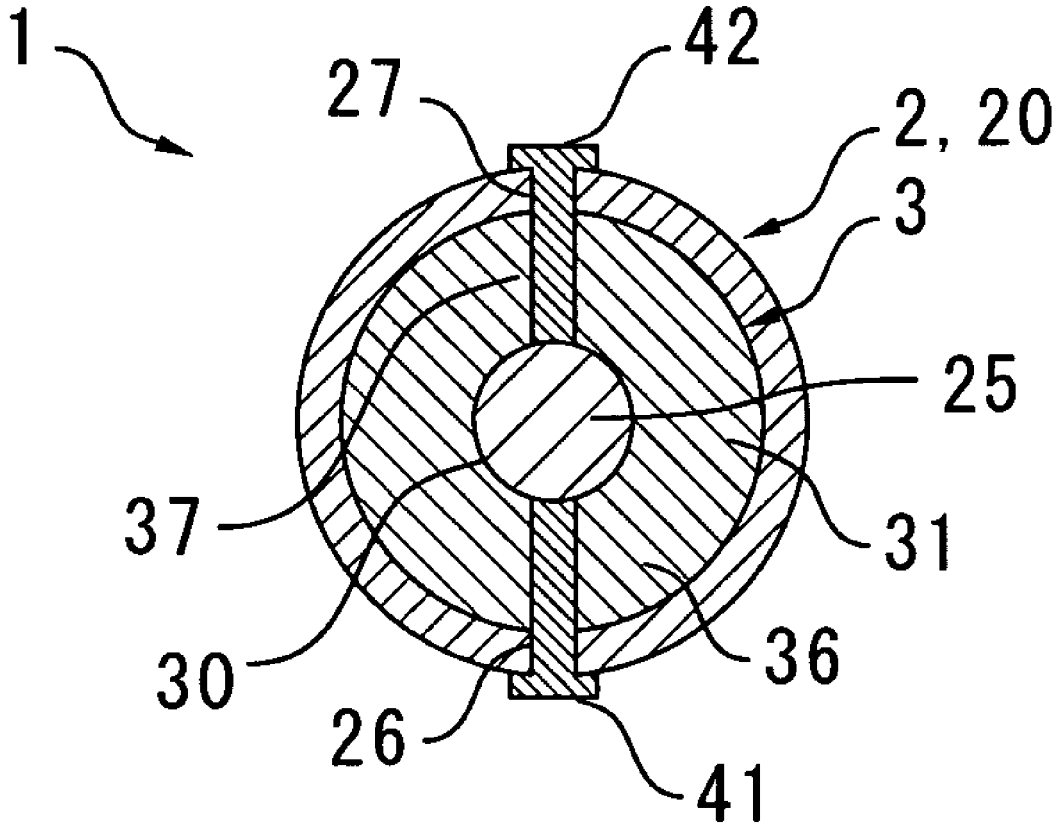
FIG. 2 is a cross-sectional view through a section in which the polisher brush depicted in FIG. 1 is fixed in place with screws.
Figure 3:
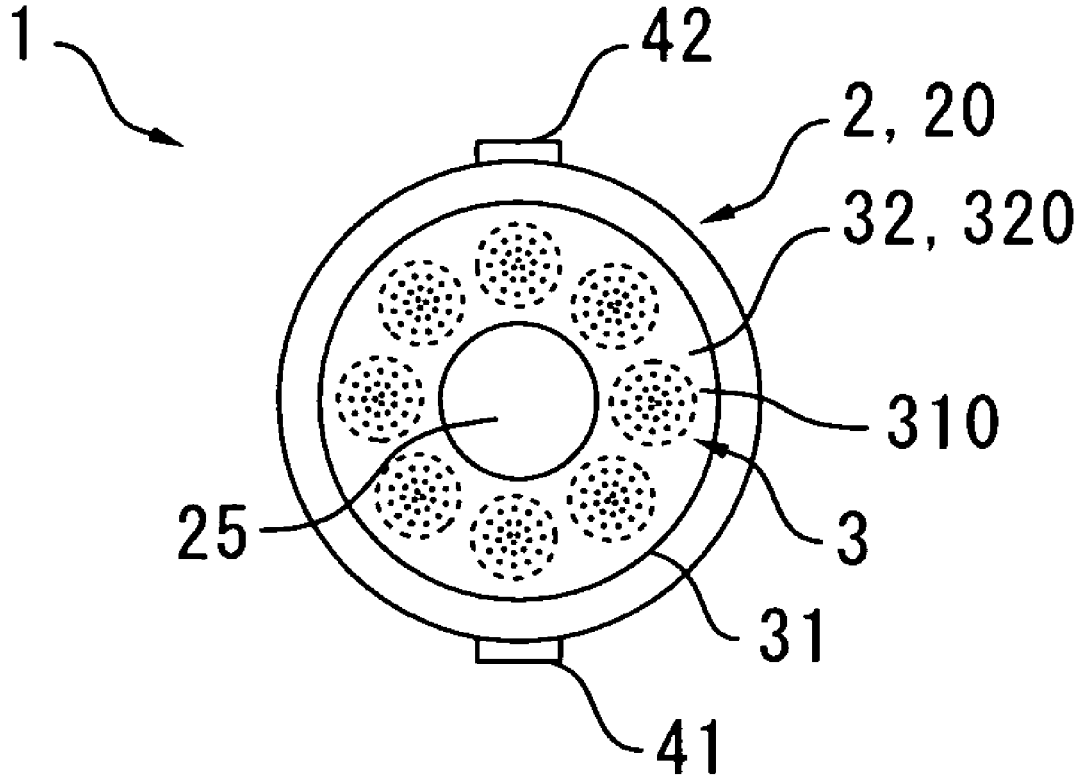
FIG. 3 is a bottom view of the polisher brush depicted in FIG. 1.
Figure 4:
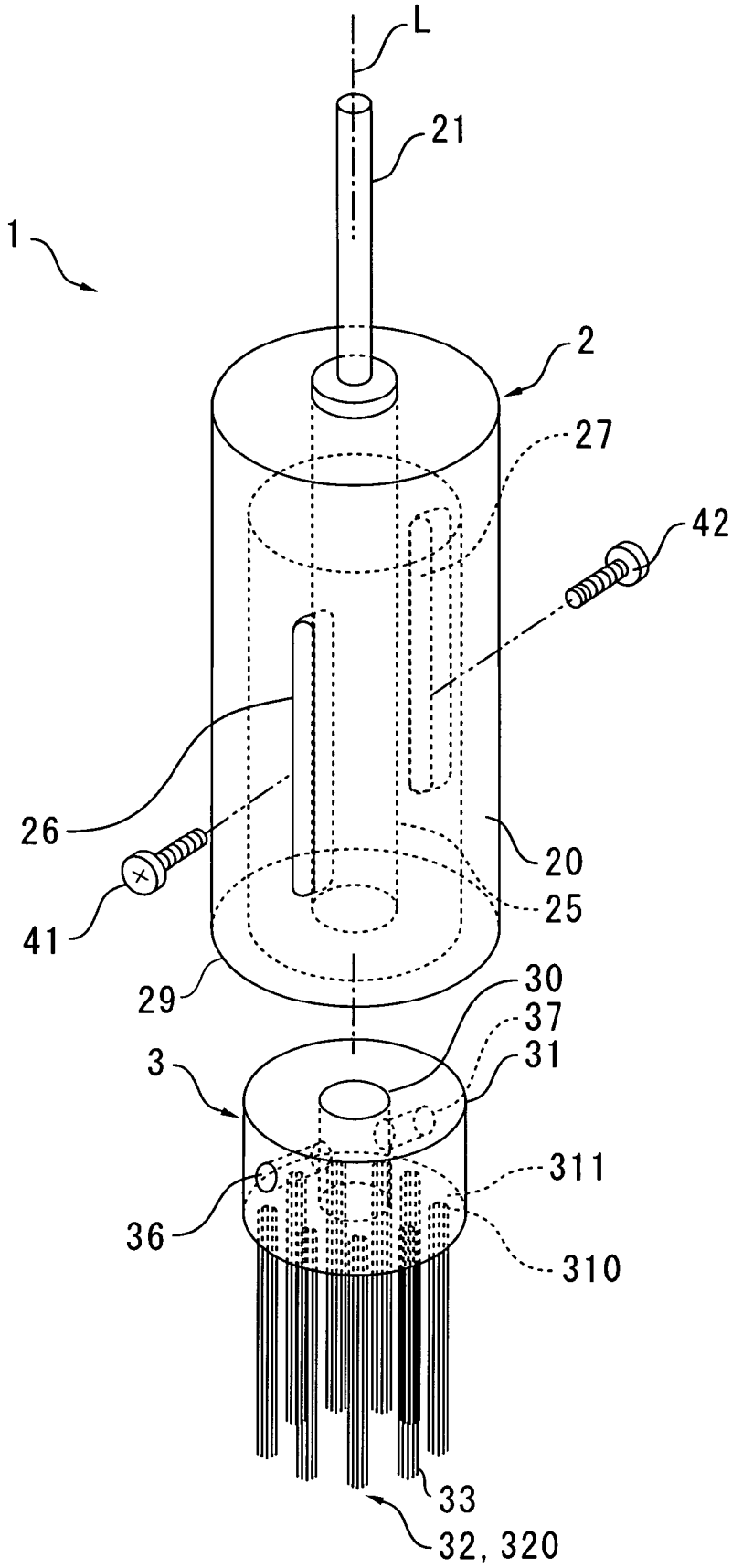
FIG. 4 is an exploded perspective view depicting the state in which the polisher brush depicted in FIG. 1 is disassembled into a brush case and a brush-shaped grindstone.
Figure 5:
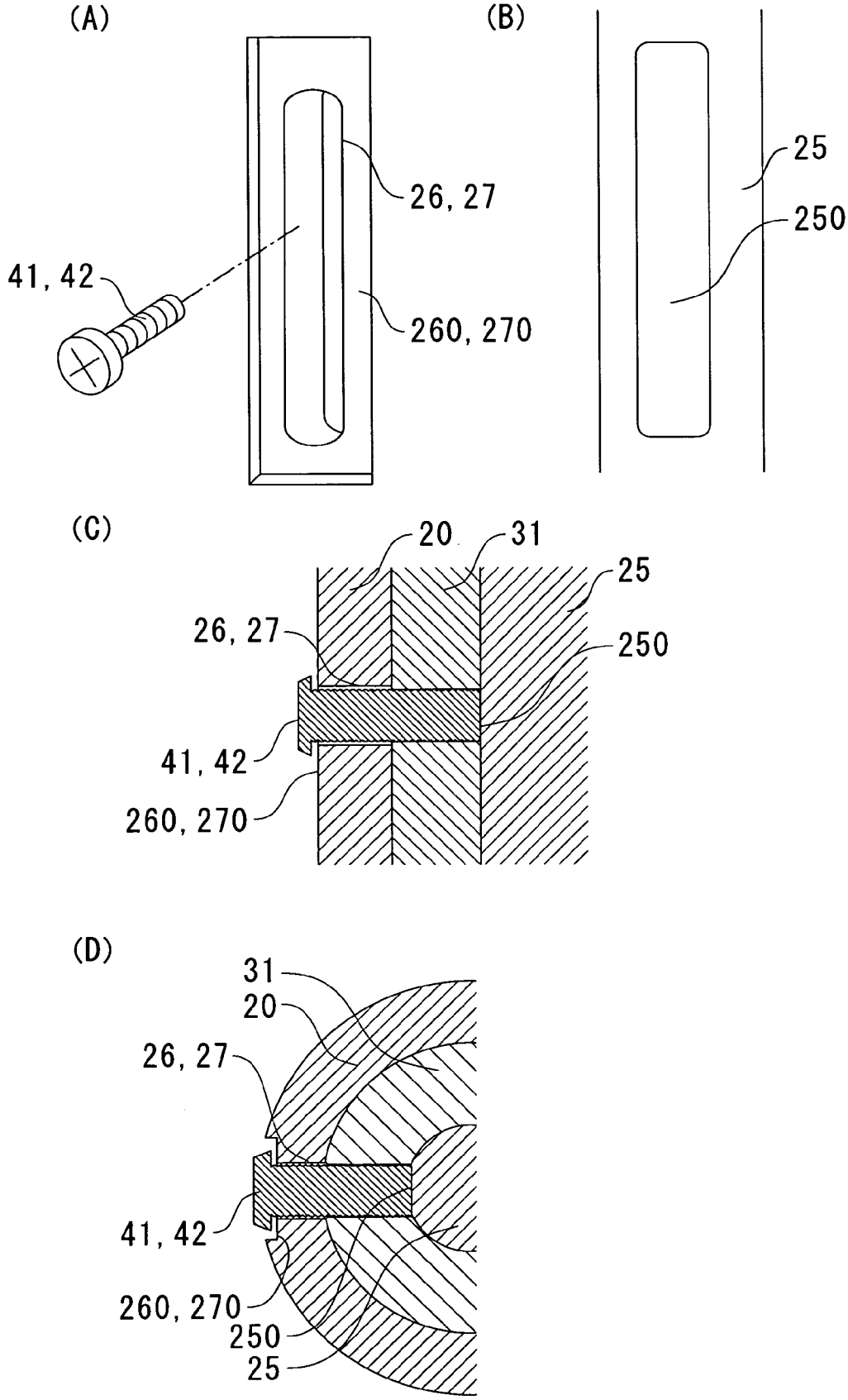
FIGS. 5 to (D) are, respectively, a diagram depicting the state in which the surrounding region where the guide holes open is made into a flat surface on the external peripheral surface of the peripheral wall of the brush case in the polisher brush depicted in FIG. 1; a diagram depicting the state in which the surrounding region where the leading end portions of the screw shaft portions make contact on the external peripheral surface of the spindle; a longitude-sectional view depicting an enlarged view of the portion that stops the screw; and a cross-sectional view depicting an enlarged view of the portion that stops the screw.

FIG. 1 is a diagram depicting a state in which an upper portion (holder side) of a brush-shaped grindstone is inserted and fixed in an interior of a brush case in a polisher brush wherein the present invention has been applied. FIG. 2 is a cross-sectional view through a section in which the polisher brush depicted in FIG. 1 is fixed in place with screws. FIG. 3 is a bottom view of the polisher brush depicted in FIG. 1. FIG. 4 is an exploded perspective view depicting a state in which the polisher brush depicted in FIG. 1 is disassembled into the brush case and the brush-shaped grindstone. FIGS. 5(A), (B), (C), and (D) are, respectively, a diagram depicting a state in which a surrounding region where the guide holes open is made into a flat surface on an external peripheral surface of a peripheral wall of the brush case in the polisher brush depicted in FIG. 1; a diagram depicting a state in which a surrounding region where a leading end portion of an axle portion of a screw makes contact on an external peripheral surface of the spindle; a longitude-sectional view depicting an enlarged view of a portion that stops the screw; and a cross-sectional view depicting an enlarged view of the portion that stops the screw.

As shown in FIGS. 1 to 4, the polisher brush 1 of the present embodiment comprises a cylindrical metal brush case 2 that comprises a connecting shaft 21 for driving on an upper portion; a brush-shaped grindstone 3 whose upper portion is inserted into this brush case 2; and screws 41 and 42 for fixing this brush-shaped grindstone 3 in a predetermined position inside the brush case 2.

In the present embodiment, an upper end portion of a round virgate spindle 25 is fixed in the center of an upper bottom portion of the brush case 2, and this spindle 25 extends in a direction of an axis line L concentrically with a peripheral wall 20 in the interior side of the brush case 2. On the peripheral wall 20 of the brush case 2, guide holes 26 and 27, extended in the form of a groove in a direction parallel to the direction of the axis line L thereof, are formed in point-symmetrical positions on opposite sides of the axis line L. In the present invention, the brush case 2 is composed such that the peripheral wall 20 is aluminum and the spindle 25 is stainless steel.

In the present embodiment, the brush-shaped grindstone 3 comprises a cylindrical metal holder 31 wherein a plurality of embedding holes 310 are formed in isolated positions on a grinding element holding surface 311, and rod assemblies 320 whose base end portions are embedded in the embedding holes 310. The rod assemblies 320 comprise a large number of wire-shaped grinding elements 32, obtained such that a composite yarn composed of inorganic filaments such as alumina filaments is impregnated and hardened with a binder resin. An axle hole 30 through which the spindle 25 is inserted is formed in a center of the holder 31. A pair of screw holes 36 and 37 is formed in a peripheral wall of the holder 31 in point-symmetrical positions on the opposite sides of the axis line L, and these screw holes 36 and 37 reach from the external peripheral surface of the peripheral wall of the holder 31 to the axle hole 30.

Thus, the brush-shaped grindstone 3 used in the present embodiment has excellent grindability because large numbers of the wire-shaped grinding elements 32 are subdivided as roundly bundled rod assemblies 320 and fixed with adhesive in the plurality of embedding holes 310 of the holder 31, so the shavings are efficiently expelled during grinding work and the heat dissipating effect is high. Removal of burrs and work marks from the precision work component, polishing, and other processes can further be performed with good efficiency and high accuracy. The cost can also be reduced because high grinding performance can be obtained with a small number of rods. Adopting a configuration in which large numbers of the wire-shaped grinding elements 32 are subdivided and fixed makes it possible to prevent the wire-shaped grinding elements 32 from unraveling. This configuration is therefore advantageous in that it is highly safe.

When assembling the polisher brush 1 using the brush-shaped grindstone 3 and the brush case 2 configured in this manner, the spindle 25 is fitted in the axle hole 30 of the holder 31, the upper portion (on a side of the holder 31) of the brush-shaped grindstone 3 is inserted inside the brush case 2, the screws 41 and 42 are thereafter passed through the guide holes 26 and 27 from the external peripheral side of the brush case 2, as shown in FIGS. 5(C) and (D), and the screws 41 and 42 are respectively screwed into the screw holes 36 and 37 of the holder 31. At this point, the screws 41 and 42 are tightened until the leading end portions of the axle portions of the screws 41 and 42 make contact with the external peripheral surface of the spindle 25. As a result, the holder 31 is fixed onto the spindle 25 of the brush case 2 by way of the screws 41 and 42 inside the brush case 2.

The screws 41 and 42 are shallowly screwed into the screw holes 36 and 37 of the holder 31 through the guide holes 26 and 27 of the brush case 2, and, in this state, the position of the brush-shaped grindstone 3 inside the brush case 2 can be adjusted in the direction of the axis line L by moving the brush-shaped grindstone 3 inside the brush case 2 in the direction of the axis line L. A protruding length of a free end 33 of the wire-shaped grinding elements 32 at a lower end portion 29 of the brush case 2 can be adjusted, so the stiffness of the wire-shaped grinding elements 32, in other words, the grindability and conformability can be optimized.

Adopting such a fixed configuration by way of the screws 41 and 42 entails having flat surfaces 260 and 270 on an external peripheral surface of the peripheral wall 20 of the brush case 2 in the area surrounding the openings of the guide holes 26 and 27, as shown in FIGS. 5(A), (C), and (D). A surrounding area where the leading end portions of the axle portions of the screws 41 and 42 make contact on the external peripheral surface of the spindle 25 is a flat surface 250, as shown in FIGS. 5(B), (C), and (D).

The polisher brush 1 assembled in this manner is linked to a polisher by way of a connecting shaft 21 for driving, which protrudes at a top portion of the brush case 2. The polisher brush 1 is then rotatably driven about the axis line L to remove all types of burrs and perform polishing work. Here, the polisher brush 1 is not limited to rotary motion, but reciprocating action, oscillating action, swinging action, or a combination of these actions may be used to conduct motion. The movement may also be combined with motion that vertically moves the brush 1 for polishing in the direction of the axis line L.

As such burr removal and polishing work is performed, the wire-shaped grinding elements 32 also abrade as such, and the protruding length of the wire-shaped grinding elements 32 at the lower end portion 29 of the brush case 2 becomes shorter. Excellent burr removal and polishing work cannot be performed in this situation, so the protruding length of the wire-shaped grinding elements 32 at the lower end portion 29 of the brush case 2 must be adjusted and the stiffness of the wire-shaped grinding elements 32, in other words, the grindability and conformability must be adjusted.

This adjustment operation entails loosening the screws 41 and 42, moving the brush-shaped grindstone 3 in the direction of the axis line L inside the brush case 2, and shifting the position of the brush-shaped grindstone 3 downward in direction of the axis line L inside the brush case 2. The protruding length of the free end 33 of the wire-shaped grinding elements 32 at the lower end portion 29 of the brush case 2 can therefore again be adjusted to an optimal length.

The brush-shaped grindstone 3 at this time moves in the brush case 2 along the guide holes 26 and 27, because the screws 41 and 42, which are screwed into the screw holes 36 and 37 of the brush-shaped grindstone 3 through the guide holes 26 and 27 from the external peripheral side of the brush case 2, are guided by the guide holes 26 and 27. As a result, in the present embodiment the screws 41 and 42 can conveniently be used to guide the brush-shaped grindstone 3 when it is moved along the guide holes 26 and 27, and to fix the brush-shaped grindstone 3 in a predetermined position within the brush case 2.

In the present embodiment, the holder 31 is fitted into the brush case 2, and the spindle 25 is fitted into the axle hole 30 of the holder 31. As a result, the holder 31 does not tilt inside the brush case 2 even with considerable dimensional tolerance between an outer diameter of the holder 31 and an inner diameter of the brush case 2. There is therefore no variation in the protruding length of the wire-shaped grinding elements 32 at the lower end portion 29 of the brush case 2. Furthermore, the depth of cutting of the wire-shaped grinding elements 32 into the work is fixed, so the precision during grinding is improved.

The holder 31 is fitted into the brush case 2, but because the spindle 25 is fitted into the axle hole 30 of the holder 31, the holder 31 remains fixed in the center position of the brush case 2 even with considerable dimensional tolerance between the outside diameter of the holder 31 and the inside diameter of the brush case 2. There is, therefore, no runout during rotation. Furthermore, the dimensional tolerance between the outside diameter of the holder 31 and the inside diameter of the brush case 2 need not to be strict. Thus, even when shavings enter a space between the holder 31 and the brush case 2, the protruding length of the wire-shaped grinding elements 32 at the lower end portion 29 of the brush case 2 can be easily adjusted because the holder 3 can be smoothly moved inside the brush case 2 by loosening the screws 41 and 42.

In the present embodiment, when the wire-shaped grinding elements 32 attempt to escape to an external peripheral side, they bump against an interior surface of the peripheral wall 20 of the brush case 2 and are held back, and when the elements attempt to escape to an interior peripheral side, they bump against the external peripheral side of the spindle 25 and are held back. As a result, there is no leeway that allows easy escape between the wire-shaped grinding elements 32 positioned on the external peripheral side and the wire-shaped grinding elements 32 positioned on the interior peripheral side. The situation in which the wire-shaped grinding elements 32 positioned on the interior peripheral side become less abrasive can therefore be avoided because no difference in rigidity is exhibited between the wire-shaped grinding elements 32 positioned on the external peripheral side and the wire-shaped grinding elements 32 positioned on the interior peripheral side. The working precision can also be improved because the wire-shaped grinding elements 32 are uniformly abraded. Since no variation occurs in the length (strand length) of the wire-shaped grinding elements 32 from the holder 31, the change in conformability and grindability due to this effect is reduced, so the working precision is stable.

In the present embodiment, the area surrounding the openings of the guide holes 26 and 27 has flat surfaces 260 and 270 on the external peripheral surface of the peripheral wall 20 of the brush case 2. In other words, heads of the screws 41 and 42 are positioned in the area surrounding the openings of the guide holes 26 and 27 on a circular-arc external surface of the peripheral wall 20 of the brush case 2. In the present embodiment, the heads to the screws 41 and 42 can be prevented from protruding far out on the external peripheral surface of the peripheral wall 20 because the area surrounding the openings of the guide holes 26 and 27 has flat surfaces 260 and 270. Even when the polisher brush 1 rotates at high speed about the axis line L, wind noise and the like can be reduced and the safety improved.

In the present invention, the surrounding area where the leading end portions of the axle portions of the screws 41 and 42 make contact on the external peripheral surface of the spindle 25 is the flat surface 250. In other words, the spindle 25 is shaped as a round bar, and the leading end portions of the screws 41 and 42 make contact on the external peripheral surface. In the present embodiment, the leading end portions of the screws 41 and 42 stably make contact with the external peripheral surface of the spindle 25 because the surrounding area where the leading end portions of the screws 41 and 42 make contact is a flat surface 250. The leading end portions of the screws 41 and 42 are prevented from shifting on the external peripheral surface of the spindle 25 even when the polisher brush 1 rotates at high speed. A space is further formed between the external peripheral surface of the spindle 25 and the internal peripheral surface of the axle hole 30 of the holder 31 in the portion in which this flat surface 250 is formed because the surrounding area where the leading end portions of the screws 41 and 42 make contact on the external peripheral surface of the spindle 25 is a flat surface 250. Therefore, even when the dimensional tolerance between the outside diameter of the spindle 25 and the inside diameter of the axle hole 30 is strict, and the tilt and eccentricity of the holder 31 is more strictly prevented, problems do not arise whereby the holder 31 inside the brush case 2 ceases moving due to the shavings that enter between the external peripheral surface of the spindle 25 and the internal peripheral surface of the axle hole 30. Even if the spindle 25 is damaged by contact made by the leading end portions of the screws 41 and 42, the holder 31 can be smoothly moved inside the brush case 2 because the holder 31 is not prevented from moving inside the brush case 2 if the damage is to the flat surface 250.

(Manufacturing Method for Brush-Shaped Grindstone 3)

FIGS. 6(A) to (E) are diagrams depicting the manufacturing method for the brush-shaped grindstone depicted in FIG. 1.

In the present embodiment, manufacturing the brush-shaped grindstone 3 used in the polisher brush 1 entails forming embedding holes 310 comprising a plurality of round holes in isolated positions in the peripheral direction on the grindstone holding surface 311 of the holder 31, as shown in FIG. 3 in connection with the present embodiment.

Figure 6:
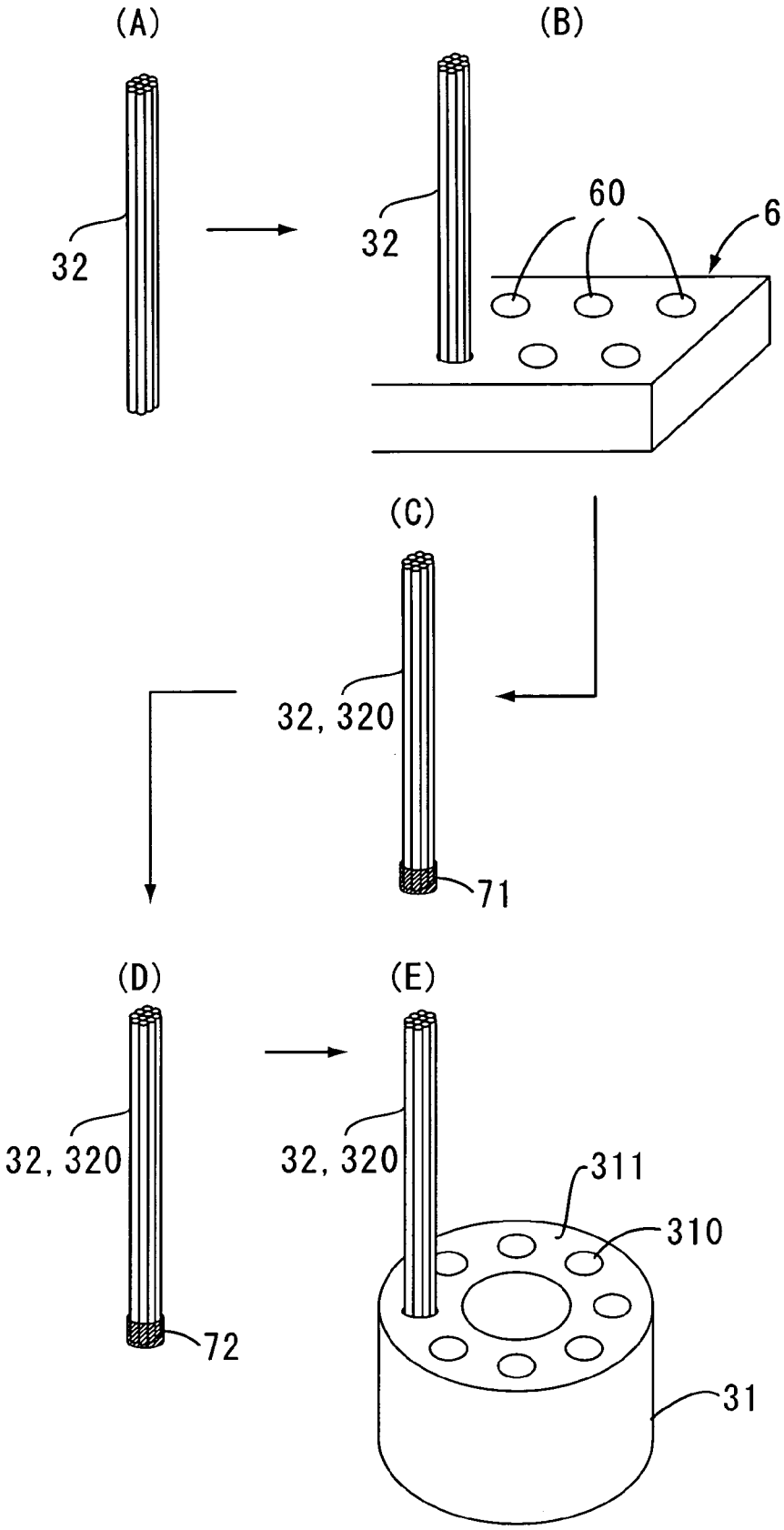
FIGS. 6(A) to (E) are diagrams depicting the manufacturing method for the brush-shaped grindstone depicted in FIG. 1.

A plurality of wire-shaped grinding elements 21 are roundly bundled in the base end sides to form rod assemblies 320, and the base end sides of the rod assemblies 320 are embedded in embedding holes 310 and fixed with adhesive. The wire-shaped grinding elements 32 are then aligned to a predetermined length, and the base end sides are thereafter aligned, as shown in FIG. 6(A). The base end sides of the wire-shaped grinding elements 32 are subsequently inserted into holes 60 in a die material 6 formed to substantially the same size as the embedding holes 310 of the holder 31, as shown in FIG. 6(B), and in this state the base end sides of the wire-shaped grinding elements 32 are fixed with silicon, epoxy, or another type of adhesive. As a result, rod assemblies 320 whose base end sides are fixed with adhesive 71 are formed, as shown in FIG. 6(C).

Silicon, epoxy, or another type of adhesive 72, for example, is subsequently applied to the base end sides of the rod assemblies 320, as shown in FIG. 6(D); this is thereafter embedded in the embedding holes 310 of the holder 32, as shown in FIG. 6(E); and in this state the adhesive 72 is hardened and the base end sides of the rod assemblies 320 are fixed in the embedding holes 310 by bonding. Thus, in the present embodiment a plurality of wire-shaped grinding elements 32 is bundled to form rod assemblies 320, which are embedded in the embedding holes 310 of the holder 31 and fixed by bonding. Therefore, because a plurality of rod assemblies 320 are batch manufactured, and these are successively inserted into the embedding holes 310 of the holder 31 and are fixed by bonding, the brush-shaped grindstone 3 can be manufactured with excellent efficiency.

In the case of nylon filaments containing abrasive grain, the nylon filaments containing abrasive grain can be prevented from unraveling by folding the base end side to provide thickness and then embedding them in holes in the holder, but wire-shaped grinding elements 32 that use inorganic filaments break when folded, so the base end side cannot be folded as can nylon filaments or other materials. According to the present embodiment, however, the base end side of a bundle of wire-shaped grinding elements 32 is hardened with adhesive 71 in advance, and the base end side thereof has substantially the same diameter as the embedding holes 310, so with the rod assemblies 320 embedded in embedding holes 310, the rod assemblies 320 do not fall over. The productivity of the brush-shaped grindstone 3 can therefore be improved. In addition, the wire-shaped grinding elements 32 do not unravel, because the base end sides of the wire-shaped grinding elements 32 are hardened with adhesive 71.

Embodiment 2

Figure 7:
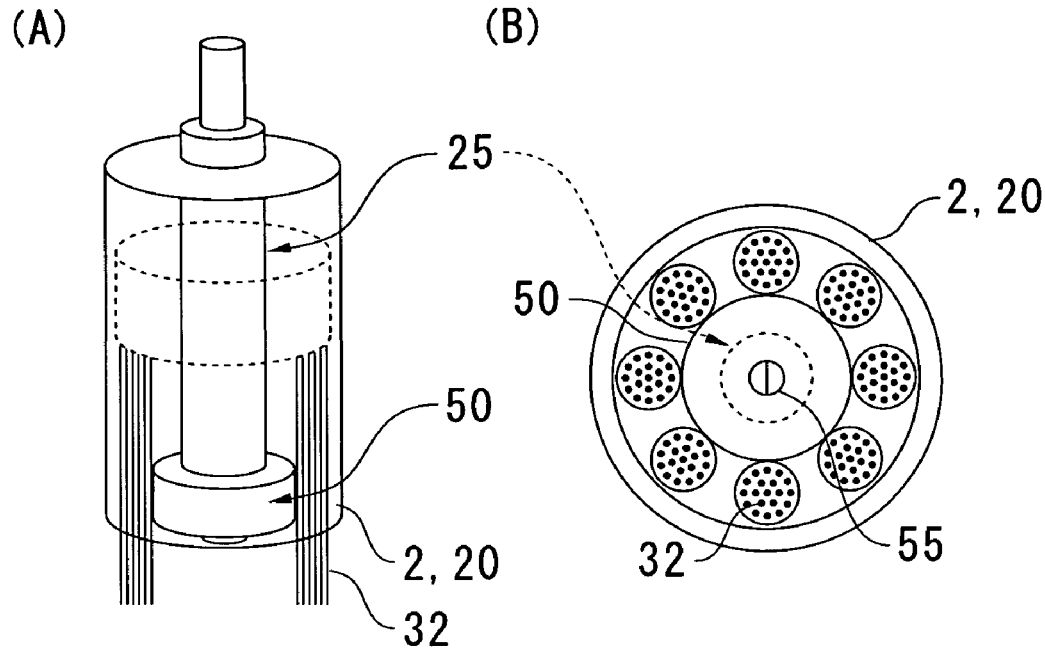
FIGS. 7(A) and (B) are, respectively, a diagram and a bottom view that schematically depict the polisher brush related to embodiment 2 of the present invention.

FIGS. 7(A) and (B) are, respectively, a diagram and a bottom view that schematically depict the polisher brush related to embodiment 2 of the present invention.

In the present embodiment, a discoid projecting portion 50 that projects to the external peripheral side is attached to the lower end side of the spindle 25 with screws 55, screw stops, or the like so as to allow easy removal, as shown in FIGS. 7(A) and (B). The other features of this structure are the same as embodiment 1, and are therefore omitted from the description.

In the present embodiment, when the wire-shaped grinding elements 32 attempt to escape to the external peripheral side, they bump against the interior surface of the peripheral wall 20 of the brush case 2 and are held back, and when the elements attempt to escape to the interior peripheral side, they bump against an external peripheral surface of the projecting portion 50 disposed on the spindle 25 and are held back. As a result, there is no leeway that allows easy escape between the wire-shaped grinding elements 32 positioned on the external peripheral side and the wire-shaped grinding elements 32 positioned on the interior peripheral side. The situation in which the wire-shaped grinding elements 32 positioned on the interior peripheral side become less abrasive can therefore be avoided because no difference in rigidity is exhibited between the wire-shaped grinding elements 32 positioned on the external peripheral side and the wire-shaped grinding elements 32 positioned on the interior peripheral side. The working precision can also be improved because the wire-shaped grinding elements 32 are uniformly abraded. Since no variation occurs in the length (strand length) of the wire-shaped grinding elements 32 from the holder 31, the change in grindability and conformability due to this effect is reduced, so the working precision is stable.

The holder 31 can be removed from the spindle 25 merely by removing the projecting portion 50 because the projecting portion 50 is attached with a screw 55 to the spindle 25 so as to allow easy removal. When the wire-shaped grinding elements 32 become worn out, the work of replacing the wire-shaped grinding elements 32 and the holder 31 with new ones can therefore easily be performed.

Embodiment 3

Figure 8:
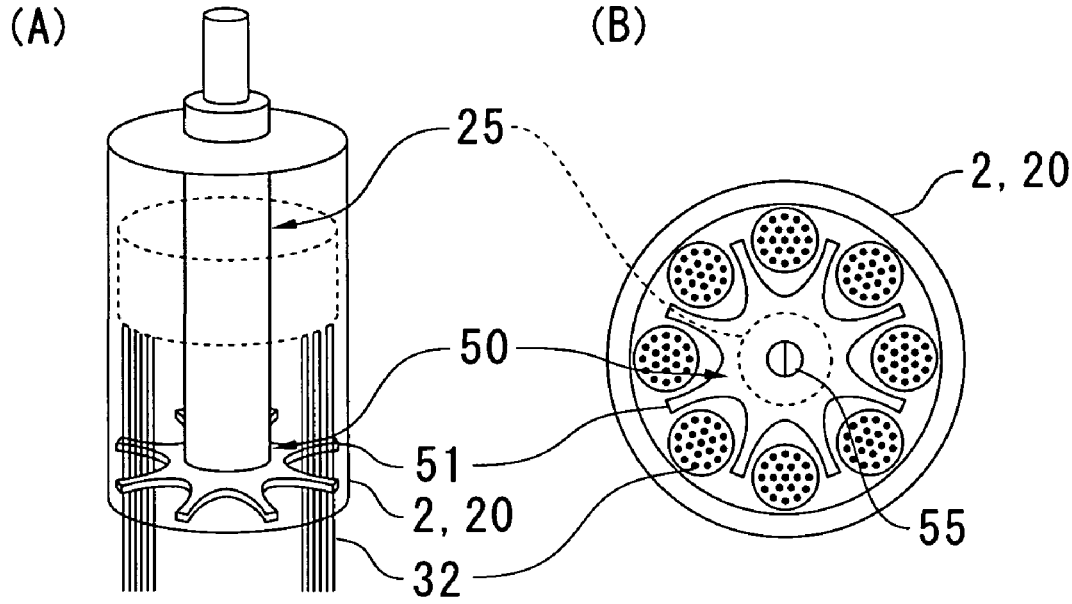
FIGS. 8(A) and (B) are, respectively, a diagram and a bottom view that schematically depict the polisher brush related to embodiment 3 of the present invention.

FIGS. 8(A) and (B) are, respectively, a diagram and a bottom view that schematically depict the polisher brush related to embodiment 3 of the present invention.

In the present embodiment, a projecting portion 50 that projects to the external peripheral side at the lower end side is attached to the lower end surface of the spindle 25 with screws 55, screw stops, or the like so as to allow easy removal, as shown in FIGS. 8(A) and (B); a plurality of protrusions 51 extended in a radial manner toward the external peripheral side are further formed on an external peripheral side of this projecting portion 50; and wire-shaped grinding elements 32 are evenly positioned between these protrusions 51. The other features of this structure are the same as embodiment 1, and are therefore omitted from the description.

In the present embodiment, when the wire-shaped grinding elements 32 attempt to escape to the external peripheral side, they bump against the interior surface of the peripheral wall 20 of the brush case 2 and are held back, and when the elements attempt to escape to the interior peripheral side, they bump against the external peripheral side of the projecting portion 50 disposed on the spindle 25, escape is restrained, and the range of escape is narrowed by the protrusions 51. As a result, there is no difference in the extend of escape between the wire-shaped grinding elements 32 positioned on the external peripheral side and the wire-shaped grinding elements 32 positioned on the interior peripheral side. The situation in which the wire-shaped grinding elements 32 positioned on the interior peripheral side become less abrasive can therefore be avoided because no difference in rigidity is exhibited between the wire-shaped grinding elements 32 positioned on the external peripheral side and the wire-shaped grinding elements 32 positioned on the interior peripheral side. The working precision can also be improved because the wire-shaped grinding elements 32 are uniformly abraded. Since no variation occurs in the length (strand length) of the wire-shaped grinding elements 32 from the holder 31, the change in grindability and conformability due to this effect is reduced, so the working precision is stable.

Furthermore, the variation in the rigidity of the wire-shaped grinding elements 32 can be reduced in the peripheral direction as well because the wire-shaped grinding elements 32 can be prevented from escaping in the peripheral direction by the protrusions 51.

The holder 31 can be removed from the spindle 25 merely by removing the projecting portion 50 because the projecting portion 50 is attached with a screw 55 to the spindle 25 so as to allow easy removal. When the wire-shaped grinding elements 32 become worn out, the work of replacing the wire-shaped grinding elements 32 and the holder 31 with new ones can therefore easily be performed.

Embodiment 4

Figure 9:
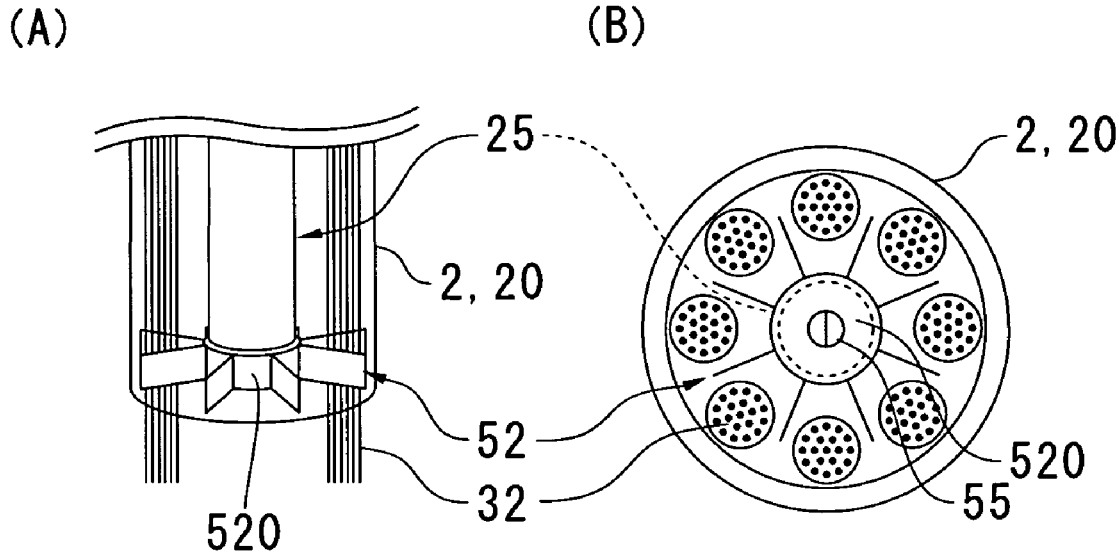
FIGS. 9(A) and (B) are, respectively, a diagram and a bottom view that schematically depict the polisher brush related to embodiment 4 of the present invention.

FIGS. 9(A) and (B) are, respectively, a diagram and a bottom view that schematically depict the polisher brush related to embodiment 4 of the present invention.

In the present embodiment, a cylindrical body 520 comprising a plurality of protrusions 52 in a form of blades extended in a radial manner toward the external peripheral side is attached to the lower end surface of the spindle 25 with screws 55, screw stops, or the like so as to allow easy removal, as shown in FIGS. 9(A) and (B), and wire-shaped grinding elements 32 are evenly positioned between these protrusions 52. The other features of this structure are the same as embodiment 1, and are therefore omitted from the description.

In the present embodiment, when the wire-shaped grinding elements 32 attempt to escape to the external peripheral side, they bump against the interior surface of the peripheral wall 20 of the brush case 2 and are held back. When the wire-shaped grinding elements 32 attempt to escape to the interior peripheral side, they bump against the external peripheral surface of the spindle 25, escape is restrained, and the range of escape is narrowed by the protrusions 52. As a result, there is no difference in the extend of escape between the wire-shaped grinding elements 32 positioned on the external peripheral side and the wire-shaped grinding elements 32 positioned on the interior peripheral side. The situation in which the wire-shaped grinding elements 32 positioned on the interior peripheral side become less abrasive can therefore be avoided because no difference in rigidity is exhibited between the wire-shaped grinding elements 32 positioned on the external peripheral side and the wire-shaped grinding elements 32 positioned on the interior peripheral side. The working precision can also be improved because the wire-shaped grinding elements 32 are uniformly abraded. Since no variation occurs in the length (strand length) of the wire-shaped grinding elements 32 from the holder 31, the change in grindability and conformability due to this effect is reduced, so the working precision is stable.

Furthermore, the variation in the rigidity of the wire-shaped grinding elements 32 can be reduced in the peripheral direction as well because the wire-shaped grinding elements 32 can be prevented from escaping in the peripheral direction by the protrusions 52.

The holder 31 can be removed from the spindle 25 merely by removing the cylindrical body 520 because the cylindrical body 520 comprising blade-shaped protrusions 52 is attached with a screw 55 to the spindle 25 so as to allow easy removal. When the wire-shaped grinding elements 32 become worn out, the work of replacing the wire-shaped grinding elements 32 and the holder 31 with new ones can therefore easily be performed.

Embodiment 5

Figure 10:
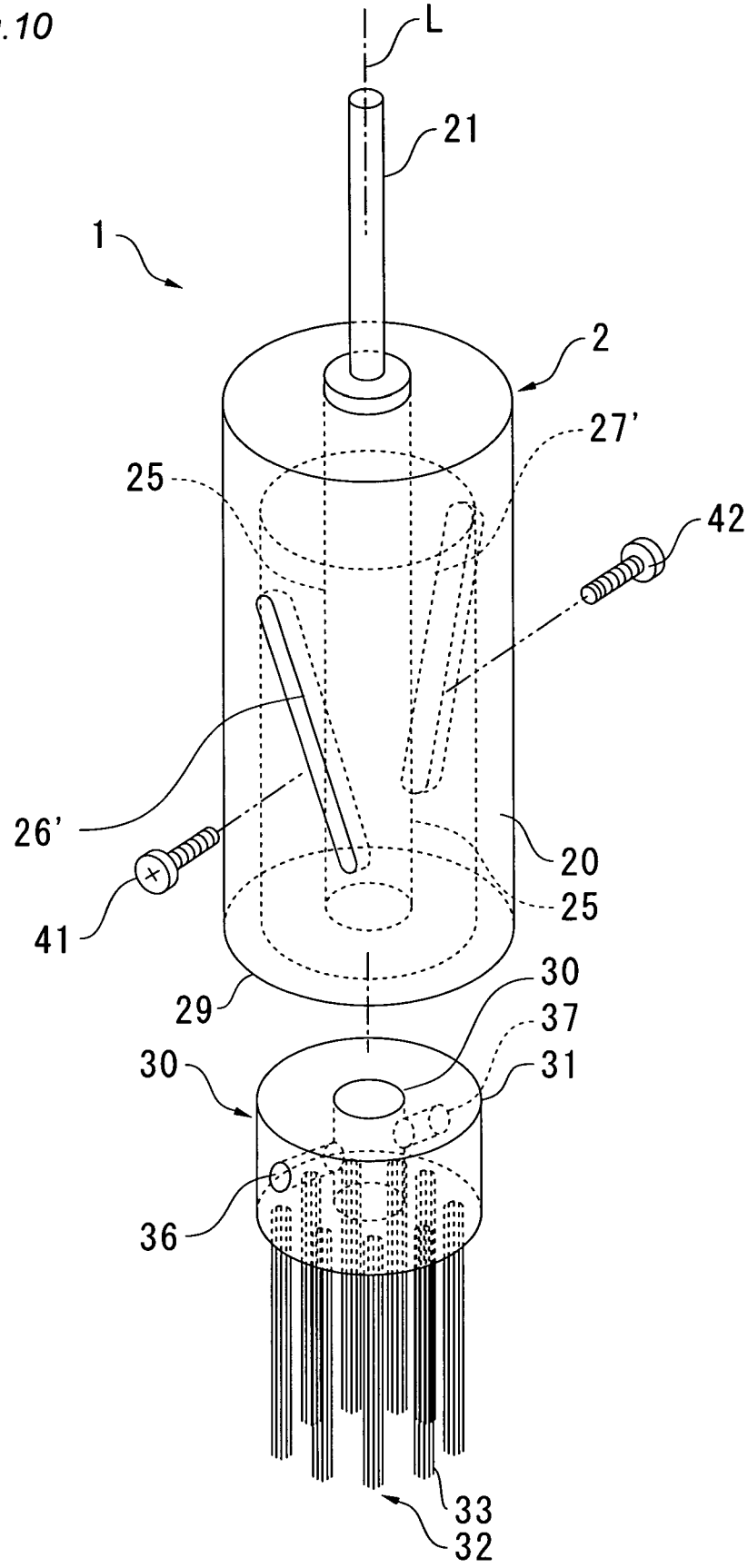
FIG. 10 is an exploded perspective view depicting the state in which the polisher brush related to embodiment 5 is disassembled into a brush case and a brush-shaped grindstone.

FIG. 10 is an exploded perspective view depicting the state in which the polisher brush related to embodiment 5 is disassembled into the brush case and the brush-shaped grindstone.

The polisher brush in the present embodiment has fundamentally the same configuration as embodiment 1, and differs only in the configuration of the guide holes formed in the peripheral wall of the brush case. Portions having common functions have the same key symbols and are omitted from the description.

As shown in FIG. 10, the polisher brush 1 of the present embodiment comprises the cylindrical metal brush case 2 with the connecting shaft 21 for driving on the upper portion, the brush-shaped grindstone 3 whose upper portion is inserted into this brush case 2, and screws 41 and 42 for fixing this brush-shaped grindstone 3 in a predetermined position inside the brush case 2. The brush-shaped grindstone 3 comprises a large number of wire-shaped grinding elements 32, and the cylindrical metal holder 31 for collectively holding the base end sides of these wire-shaped grinding elements 32.

In the present embodiment as well, a pair of screw holes 36 and 37 is formed in the peripheral wall of the holder 31 in point-symmetrical positions on the opposite sides of the axis line L.

On the peripheral wall 20 of the brush case 2, guide holes 26' and 27' extended in the form of a groove in a direction diagonal to the direction of the axis line L thereof are formed in point-symmetrical positions on the opposite sides of the axis line L. Here, the guide holes 26' and 27' extend in a direction diagonal about 20° to the direction of the axis line L, for example.

In the present embodiment as well, when assembling a polisher brush 1 using the brush-shaped grindstone 3 and the brush case 2, the spindle 25 is fitted in the axle hole 30 of the holder 31, the upper portion (on the side of the holder 31) of the brush-shaped grindstone 3 is inserted inside the brush case 2 in the same manner as embodiment 1, the screws 41 and 42 are thereafter passed through the guide holes 26' and 27' from the external peripheral side of the brush case 2, as described with reference to FIGS. 5(C) and (D), and the screws 41 and 42 are respectively screwed into the screw holes 36 and 37 of the holder 31. At this point, the screws 41 and 42 are tightened until the leading end portions of the axle portions of the screws 41 and 42 make contact with the external peripheral surface of the spindle 25. As a result, the holder 31 is fixed onto the spindle 25 of the brush case 2 by way of the screws 41 and 42 inside the brush case 2.

At this point, the screws 41 and 42 are shallowly screwed into the screw holes 36 and 37 of the holder 31 through the guide holes 26' and 27' of the brush case 2, and, in this state, the position of the brush-shaped grindstone 3 inside the brush case 2 can be adjusted in the direction of the axis line L by moving the brush-shaped 3 inside the brush case 2 in the direction of the axis line L. The protruding length of the free end 33 of the wire-shaped grinding elements 32 at the lower end portion 29 of the brush case 2 can be adjusted, so the stiffness of the wire-shaped grinding elements 32, in other words, the grindability and conformability can be optimized.

Here, the guide holes 26' and 27' for guiding the brush-shaped grindstone 3 extend toward the peripheral wall 20 of the brush case 2 in a direction diagonal to the axis line L. As a result, the angle to the direction of the axis line L of the guide holes 26' and 27' is set to θ°, and if the brush-shaped grindstone 3 was moved the distance L1 along the guide holes 26' and 27', the brush-shaped grindstone 3 essentially moves the distance $L2=(L1\cdot/\cos\theta)$, even though it was moved the distance L1 along the guide holes 26' and 27'. In other words, when one wants to move the brush-shaped grindstone 3 the distance L2 in the direction of the axis line L, the brush-shaped grindstone 3 need only to be moved the distance $L1=(L2/\cos\theta)$ along the guide holes 26' and 27'.

Therefore, according to the present invention, the protruding length of the free end 33 of the brush-shaped grindstone 3 can easily and quickly be adjusted to an optimal state because the position of the brush-shaped grindstone 3 in the direction of the axis line L in the brush case 2 can easily be adjusted in small increments. Thus, because the stiffness of the wire-shaped grinding elements 32, in other words, the grindability and conformability can easily and quickly be adjusted, high quality burr removal and polishing work can be performed.

When the brush-shaped grindstone 3 does not easily move inside the brush case 2, according to the present embodiment, brush-shaped grindstone 3 can still be moved smoothly because force is applied to the brush-shaped grindstone 3 in the direction in which the brush-shaped grindstone 3 rotates about the axis line L.

The protruding portion 50 described in embodiment 2 may be disposed on the spindle 25 in the polisher brush 1 in the present embodiment.

The flat surfaces 250, 260, and 270 described in embodiment 1 may be disposed on the spindle 25 or on the peripheral wall 20 of the brush case 2 in the present embodiment as well.

Other Embodiment 1

Figure 11:
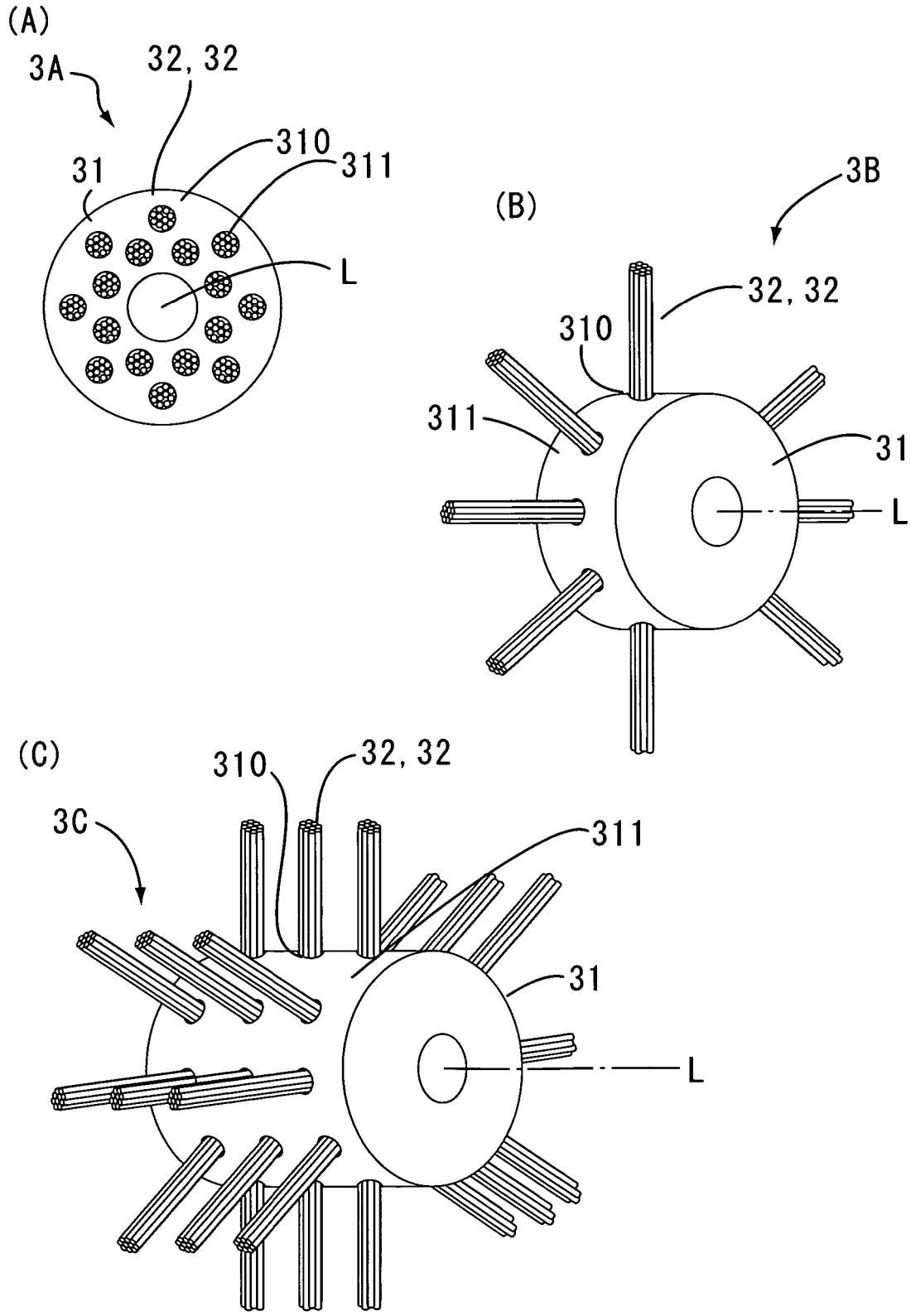
FIGS. 11(A), (B), and (C) are diagrams depicting the structure of the brush-shaped grindstone related to other embodiment 1 of the present invention.

The brush-shaped grindstone 3 related to the above embodiments is an example in which the bottom surface of the cylindrical holder 31 serves as the grinding element holding surface 311, and a plurality of embedding holes 310 are formed in a single line about the axis line L of the center of rotation, but the present invention may also be applied to a brush-shaped grindstone 3A in which rod assemblies 320 are embedded in the embedding holes 310 that comprise a plurality of round holes formed in a plurality of lines; for example, two lines, about the axis line L of the center of rotation in the grinding element holding surface 311 comprising the bottom surface of the cylindrical holder 31, as shown in FIG. 11(A).

The present invention may also be applied to brush-shaped grindstones 3B and 3C in which rod assemblies 320 are embedded in embedding holes 310. The holes comprise a plurality of round holes formed about the axis line L of the center of rotation in the grinding element holding surface 311, itself comprising the side surface of the cylindrical or columnar holder 31, as shown in FIGS. 11(B) and (C).

Although this is not shown in the drawings, the present invention may further be applied to a brush-shaped grindstone in which rod assemblies are embedded in embedding holes that comprise a plurality of round holes formed at irregular positions about the axis line of the center of rotation in the grinding element holding surface of holders of various shapes.

Other Embodiment 2

Figure 12:
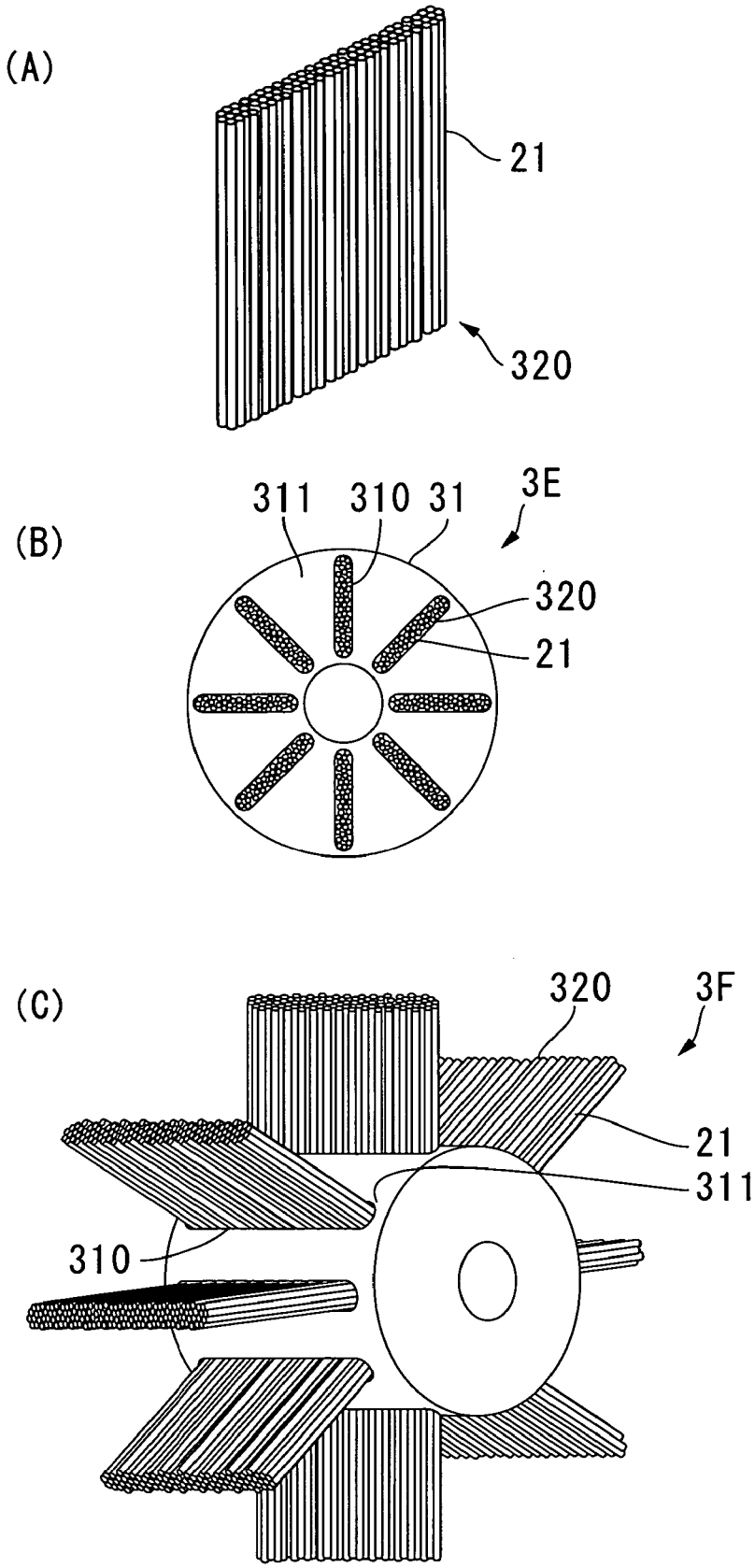
FIGS. 12(A), (B), and (C) are diagrams depicting the structure of the brush-shaped grindstone related to other embodiment 2 of the present invention.

The embodiments described above entail the use of rod assemblies 320 in which the base end portions of a plurality of the wire-shaped grinding elements 21 are roundly bundled, but it is also possible to use rod assemblies 320 in which the base end portions of a plurality of wire-shaped grinding elements 21 are flatly aligned, as shown in FIG. 12(A).

In this case, a plurality of embedding holes 310 in the form of grooves are formed on the grinding element holding surface 311 comprising the bottom surface of the cylindrical holder 31, rod assemblies 320 in which the base end portions of the plurality of wire-shaped grinding elements 21 are flatly aligned are formed, and the base end sides of these rod assemblies 320 may be fixed with adhesive in the embedding holes 310 of the holder 31, in the manner of the brush-shaped grindstone 3E shown in FIG. 12(B).

A plurality of embedding holes 310 in the form of grooves are formed on the grinding element holding surface 311 comprising the side surface of the cylindrical or columnar holder 31, rod assemblies 320 in which the base end portions of the plurality of wire-shaped grinding elements 21 are flatly aligned are formed, and the base end sides of these rod assemblies 320 may be fixed with adhesive in the embedding holes 310 of the holder 31, in the manner of the brush-shaped grindstone 3F shown in FIG. 12(C).

Other Embodiment 3

The above embodiments were described with reference to an example in which the brush-shaped grindstone 3 was wire-shaped grinding elements 32 formed such that the composite yarn composed of inorganic filaments such as alumina filaments was impregnated and hardened with a binder resin, but the present invention may also be applied to a polisher brush wherein the brush-shaped grinding material 3 is wire-shaped grinding elements 32 obtained such that nylon (resin) that contains silicon carbide or other abrasive grains is molded into filaments, or to a polisher brush wherein brass or stainless steel wire-shaped grinding elements 32 are used as the brush-shaped grinding material 3. Carbon nanotubes may also be admixed into the binder resin when the wire-shaped grinding elements 32 are constructed.

In the above embodiments, the composite yarn with the substantially circular cross-section was used in the wire-shaped grinding elements 32 without twisting the inorganic filaments, but a configuration obtained by twisting the inorganic filaments into a composite yarn may also be adopted. When inorganic filaments are twisted into the composite yarn, an advantage is obtained whereby the leading ends of the wire-shaped grinding elements 32 are resistant to splitting.

In the above embodiments, the cross-sections of the wire-shaped grinding elements 32 assume a configuration in which the shape is substantially circular, but a configuration in which the cross-section is flat may also be adopted. When the cross-sections of the wire-shaped grinding elements are flat, plugging is minimal during burr removal and polishing in comparison with the configuration in which the shape of the cross-section is substantially circular. An advantage is obtained whereby flexibility is exhibited in the wire-shaped grinding elements, and breaking is minimized. When the cross-sections of the wire-shaped grinding elements are flat, the ratio of flatness represented by L/T is preferably 1.6 to 15, but is more preferably in a range of 1.6 to 10, where L is the length of the cross-section, and T is the breadth of the cross-section.

INDUSTRIAL APPLICABILITY

As described above, according to the present invention, a plurality of wire-shaped grinding elements are bundled to form rod assemblies, and these are embedded in the embedding holes of the holder and fixed by bonding. As a result, a plurality of rod assemblies are batch manufactured, and these are successively inserted into the embedding holes of the holder and fixed. The brush-shaped grindstone can therefore be manufactured with excellent efficiency.

The invention claimed is:

1. A polisher brush which comprises:

a brush-shaped grindstone having a plurality of wire-shaped grinding elements, each element being formed such that a composite yarn composed of inorganic filaments is impregnated and hardened with a resin, and a holder for holding base end side portions of the wire-shaped grinding elements;

a cylindrical brush case; and screws for fixing the holder on an interior side of the brush case so that free ends of the wire-shaped grinding elements protrude from a lower end portion of the brush case;

the brush case is formed with a spindle extending inside the brush case along an axial direction thereof, and with guide holes extending in the form of grooves in a peripheral wall of the brush case, wherein the guide holes extend parallel to the axial direction of the brush case;

the holder is formed with an axle hole in which the spindle is fitted, and with screw holes that extend from an external peripheral surface of the holder to the axle hole;

screws are secured in the screw holes so as to be attached to the external peripheral side of the brush case and to pass completely through the guide holes in a state in which leading end portions of shafts of the screws come in contact with an external peripheral surface of the spindle; and the wire-shaped grinding elements have a flat cross-section.

2. The polisher brush according to claim 1, wherein the wire-shaped grinding elements have a flat cross-section.

3. The polisher brush according to claim 1, wherein the wire-shaped grinding elements have a ratio of flatness represented by L/T that is within a range of 1.6 to 15, wherein L is a major diameter of the cross-section of the wire-shaped grinding element, and T is a minor diameter thereof.

* * * * *